US009617743B2

(12) United States Patent
Brown et al.

(10) Patent No.: US 9,617,743 B2
(45) Date of Patent: Apr. 11, 2017

(54) PRIMARY AND INTERMEDIATE HORIZONTAL LEVELER

(71) Applicant: DIRTT Environmental Solutions, Ltd., Calgary (CA)

(72) Inventors: Thomas Alfred Brown, Calgary (CA); Geoff W. Gosling, Calgary (CA); Mogens F. Smed, DeWinton (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 14/432,999

(22) PCT Filed: Aug. 13, 2014

(86) PCT No.: PCT/US2014/050959
§ 371 (c)(1),
(2) Date: Apr. 1, 2015

(87) PCT Pub. No.: WO2015/023794
PCT Pub. Date: Feb. 19, 2015

(65) Prior Publication Data

US 2016/0160512 A1 Jun. 9, 2016

Related U.S. Application Data

(60) Provisional application No. 61/866,781, filed on Aug. 16, 2013.

(51) Int. Cl.

| | |
|---|---|
| ***E04F 21/18*** | (2006.01) |
| ***E04B 2/56*** | (2006.01) |
| ***E04B 2/74*** | (2006.01) |

(52) U.S. Cl.
CPC ..... *E04F 21/1877* (2013.01); *E04B 2/56* (2013.01); *E04B 2/7422* (2013.01); *E04B 2002/749* (2013.01); *E04F 21/1894* (2013.01)

(58) Field of Classification Search
CPC ... E02D 5/80; E02D 5/801; E02D 5/74; E04F 21/18; E04F 21/1877; E04F 21/1894;
(Continued)

(56) References Cited

U.S. PATENT DOCUMENTS 2,324,545 A * 7/1943 Svirsky ..... F16L 55/132 217/109
2,940,784 A * 6/1960 Fell ..... F16B 5/0233 248/180.1

(Continued)

OTHER PUBLICATIONS

International Search Report and Written Opinion for PCT/US2014/050959 mailed Nov. 26, 2014.

*Primary Examiner* — Phi A
(74) *Attorney, Agent, or Firm* — Workman Nydegger

(57) ABSTRACT

Implementations of the present invention relate to apparatuses, systems, and methods for constructing and installing architectural walls that are secured to a floor and/or a ceiling and include one or more leveling mechanisms. The leveling mechanisms may allow the architectural wall to be selectively adjusted vertically relative to the floor and/or ceiling so that a horizontal positioning of the wall may be achieved. The leveling mechanisms may also allow the architectural wall to fit securely to a floor and/or ceiling.

23 Claims, 5 Drawing Sheets

(58) Field of Classification Search
CPC . E04B 2/56; E04B 9/241; E04B 9/245; E04B 1/3511
USPC ..... 52/126.1, 126.4, 126.5, 126.6, 126.7, 52/127.1; 248/188.5, 188.4, 188.8, 188.2
See application file for complete search history.

(56) References Cited

U.S. PATENT DOCUMENTS 3,464,670 A * 9/1969 Rasmussen ..... E04H 1/14 254/92
3,495,365 A * 2/1970 Blaski ..... E04B 7/102 52/127.1
3,606,704 A * 9/1971 denton ..... E04F 15/024 248/619
3,696,569 A * 10/1972 Didry ..... E04B 2/7854 52/126.4
3,979,864 A * 9/1976 Tillie ..... E04C 2/041 414/10
4,102,096 A * 7/1978 Cody ..... E04B 1/24 248/354.4
4,320,607 A * 3/1982 Eubank ..... B60S 9/04 52/126.6
4,417,426 A * 11/1983 Meng ..... E04B 1/34352 52/126.7
4,787,183 A * 11/1988 Johnston ..... E04G 11/48 249/28
5,120,163 A * 6/1992 Holdeman ..... E02D 27/48 405/229
5,213,448 A * 5/1993 Seider ..... E02D 35/00 405/229
5,301,480 A 4/1994 Oyama
5,862,635 A 1/1999 Linse
6,142,710 A * 11/2000 Holland, Jr. ..... E02D 33/00 405/229
6,193,442 B1 * 2/2001 May ..... E02D 35/00 405/232
6,343,444 B1 * 2/2002 Minami ..... E04B 1/2403 254/104
6,381,907 B1 5/2002 Mackarvich
6,539,685 B2 * 4/2003 Bell ..... E02D 35/00 405/229
6,607,341 B1 * 8/2003 Wade ..... A47B 96/00 187/267
6,659,692 B1 * 12/2003 May ..... E02D 35/00 405/230
6,872,031 B2 * 3/2005 May ..... E02D 35/00 405/232
7,004,683 B1 * 2/2006 Rupiper ..... E02D 5/56 405/229
7,195,426 B2 * 3/2007 May ..... E02D 5/56 405/229
7,814,711 B2 10/2010 Milligan
8,726,583 B2 * 5/2014 Verdecia ..... E04B 1/24 52/126.1
9,279,227 B2 * 3/2016 West ..... E02D 5/54
9,328,504 B2 * 5/2016 Gosling ..... E04B 2/7453
2002/0170244 A1 * 11/2002 Kim ..... E04B 1/161 52/126.5
2005/0284040 A1 * 12/2005 Hashimoto ..... E04F 15/02458 52/126.1
2009/0211178 A1 * 8/2009 Marshall ..... E02D 27/01 52/126.6
2011/0131893 A1 * 6/2011 Chen ..... E04G 25/04 52/126.6
2012/0131862 A1 * 5/2012 Hashimoto ..... E04F 15/02452 52/126.6
2013/0000224 A1 1/2013 Huene
2013/0192148 A1 8/2013 Milligan
2015/0308107 A1 * 10/2015 Duranleau ..... E04F 21/1844 52/126.4

* cited by examiner

PRIMARY AND INTERMEDIATE HORIZONTAL LEVELER

CROSS-REFERENCE TO RELATED APPLICATIONS

The present invention is a 35 U.S.C. §371 U.S. National Stage of PCT Application No. PCT/US2014/50959 entitled PRIMARY AND INTERMEDIATE HORIZONTAL LEVELER, filed Aug. 13, 2014, which claims the benefit of priority to U.S. Provisional Application No. 61/866,781 entitled PRIMARY AND INTERMEDIATE HORIZONTAL LEVELER, filed Aug. 16, 2013. The entire content of each of the aforementioned patent applications is incorporated herein by reference.

BACKGROUND OF THE INVENTION

1. The Field of the Invention

Generally, this present disclosure relates to architectural walls. More specifically, the present disclosure relates to architectural walls that allow for selective adjustment relative to a ceiling, floor, or both.

2. Background and Relevant Art

Architects and interior designers often use walls to separate space within an indoor environment, such as a home, an office, or another building. Some indoor environments have raised floor structures that are lifted above a floor surface. For example, some office buildings may include raised floors that lie above a sub floor. Similarly, some indoor environments may have suspended ceilings that are hung or suspended from a ceiling. One advantage of having raised floors and/or suspended ceilings is that they provide space for power cables, communication cables, and other unsightly hardware between the raised floor and sub floor or between a suspended ceiling and a ceiling. Thus, suspended ceilings and raised floors can hide cables, HVAC (Heating, Ventilating, and Air Conditioning), or other building infrastructure from view.

Securing an architectural wall within an indoor environment that has a raised floor and/or a suspended ceiling can be challenging. For example, suspended ceilings and raised floors may not provide sufficient structural support to be used as anchor points for top and/or bottom ends of an architectural wall. Thus, architectural walls may extend below a raised floor to be anchored to a floor and/or above a suspended ceiling to be anchored to a ceiling.

While a floor and a ceiling may provide adequate structural support for anchoring a top and/or bottom end of an architectural wall, using a floor and/or a ceiling as anchor points has its own challenges. Channels that house opposite ends of an architectural wall, for instance at the top and bottom of the architectural wall, may be cut out of or attached to a floor and/or ceiling. Unfortunately, it can be difficult or even impossible to perfectly align or level such channels or even walls within the channels, given variation in the as built dimensions versus the ideal designed dimensions of the base building context.

Thus, there are a number of problems with architectural walls that can be addressed.

BRIEF SUMMARY OF THE INVENTION

Implementations of the present disclosure solve one or more of the foregoing or other problems in the art with apparatuses, systems, and methods for constructing and installing architectural walls that are secured to a permanent structure and that include one or more leveling mechanisms. The leveling mechanisms may allow the architectural wall to be selectively adjusted horizontally relative to an imperfect permanent structure so that a level positioning of the wall may be achieved. The leveling mechanisms may also allow the architectural wall to fit securely to a permanent structure, while allowing a limited amount of side-to-side movement in the installed wall.

According to one example implementation, an architectural wall system includes a wall and a horizontal leveler. The horizontal leveler may be attached between a first end of the wall and a permanent structure. The horizontal leveler may allow a vertical position of the first end of the wall to be selectively adjusted at both a crude level and a fine level relative to the permanent structure. The architectural wall system may optionally include an upper frame adjustably connected to a lower frame, with the lower frame being connectable to the permanent structure. The fine level of vertical position may be adjusted between the upper frame and the lower frame. The crude level of vertical position may be adjusted between the lower frame and the permanent structure.

In another example implementation, an architectural wall system includes a wall, an upper frame, a lower frame, and a horizontal leveler that may connect the wall to a permanent structure. The horizontal leveler may include an intermediate displacement mechanism between the upper frame and the lower frame. The upper frame may have a v-shaped bottom end, and the lower frame may be adjustably connected to the v-shaped bottom end of the upper frame. The intermediate displacement mechanism may provide a displacement force between the upper frame and the lower frame. The intermediate displacement mechanism may include one or more threaded studs, a piston, a spring, a bushing, or combinations thereof.

Yet another example implementation provides an apparatus for leveling an architectural wall. The apparatus may include an upper frame that is capable of supporting an architectural wall and that has a first end and a second end. In some instances, the second end of the upper frame is v-shaped. The apparatus may also include a lower frame having a first end and a second end, with the lower frame being able to adjustably connect the second end of the lower frame to a permanent structure. In some instances, the second end of the lower frame comprises a 3-point connection for connecting the lower frame to a permanent structure. An intermediate displacement mechanism may connect the second end of the upper frame to the first end of the lower frame. The displacement mechanism may include a plurality of threaded studs.

A further example implementation includes a method for installing an architectural wall. The method may include connecting a lower frame to a surface of a permanent structure and crudely adjusting the connection between the lower frame and the surface of the permanent structure such that the lower frame stands about vertically. The method may also include connecting an upper frame to the lower frame and finely adjusting the connection between the upper frame and the lower frame such that the upper frame is level.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description will be rendered by reference to specific embodiments which are illustrated in the appended drawings. For better understanding, like elements have been designated by like reference numbers throughout the various accompanying figures. Understanding that these drawings depict only typical embodiments of the disclosure and are not therefore to be considered to be limiting of its scope, the embodiments will be described and explained with additional specificity and detail through the use of the accompanying drawings in which.

DETAILED DESCRIPTION OF THE PREFERRED EMBODIMENTS

One or more implementations of the present disclosure relate to constructing and installing architectural walls that are secured to a permanent structure, such as a floor, and that include one or more leveling mechanisms. The one or more leveling mechanisms may allow the architectural wall to be selectively adjusted vertically relative to the floor so that horizontal leveling of the wall may be achieved. The one or more leveling mechanisms may also allow the architectural wall to fit securely to a floor and/or ceiling, eliminating or reducing any movement in the installed wall.

Figure 1:
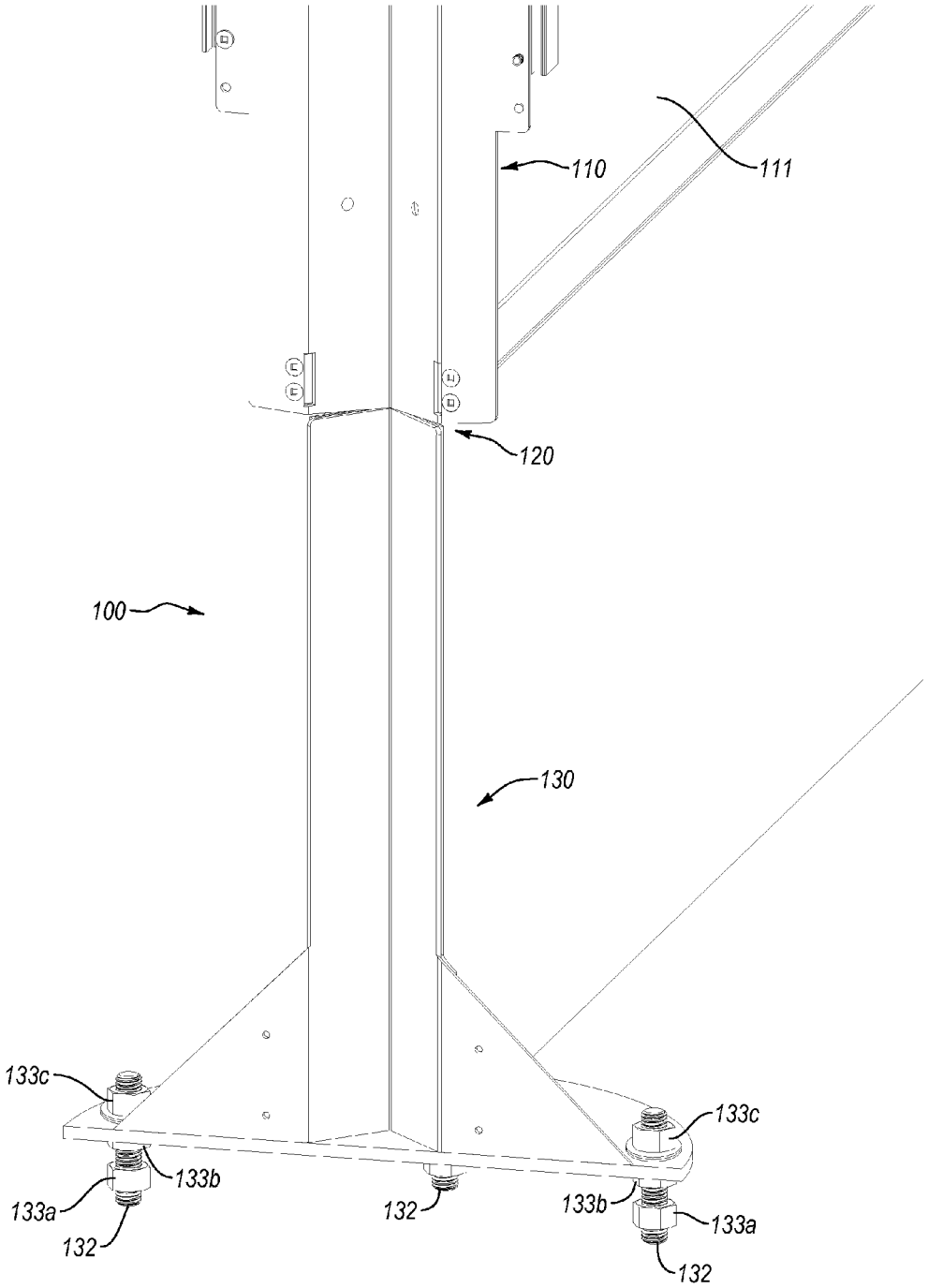
FIG. 1 is a perspective view of an architectural wall system incorporating two leveling mechanisms.

FIG. 1 illustrates a perspective view of an architectural wall system 100. The architectural wall system 100 includes an upper frame 110 that supports a wall 111, an intermediate displacement mechanism 120, and a lower frame 130. The intermediate displacement mechanism 120 and the lower frame 130 may be individually or collectively referred to as a horizontal leveler. The horizontal leveler allows for independent crude and fine leveling of at least the wall 111. As discussed in greater detail below, the architectural wall system 100 is configured to be secured to at least one permanent structure.

The wall 111 may be a modular movable wall or a permanent wall. The wall 111 may comprise any suitable material. For example, the wall 111 may be composed entirely or in part of gypsum plaster, wood, vinyl, metal, or another material. In at least one implementation, the wall 111 comprises a modular wall. The modular wall can include a frame and tile(s) or panel(s) that permanently or removably attach to the frame such as those disclosed in U.S. Pat. No. 8,024,901, titled Integrated Reconfigurable Wall System, the contents of which are hereby incorporated by reference in their entirety.

In one or more implementations, the upper frame 110 and/or wall 111 extend above a drop down ceiling, through an appropriately sized hole in the drop down ceiling. For example, the drop down ceiling may include a rectangular hole that has approximately the same dimensions as the upper frame 110 and/or wall 111 so that no significant gaps exist between the drop down ceiling and the upper frame 110 and/or wall 111. The lower frame 130, and optionally the upper frame 110 and/or the wall 111, can also extend below a raised floor, through an appropriately sized hole in the raised floor. For example, the raised floor may include a rectangular hole that has approximately the same dimensions as the lower frame 130, the upper frame 110, and/or the wall 111, so that no significant gaps exist between the raised floor and the lower frame 130, the upper frame 110 and/or the wall 111.

Figure 2:
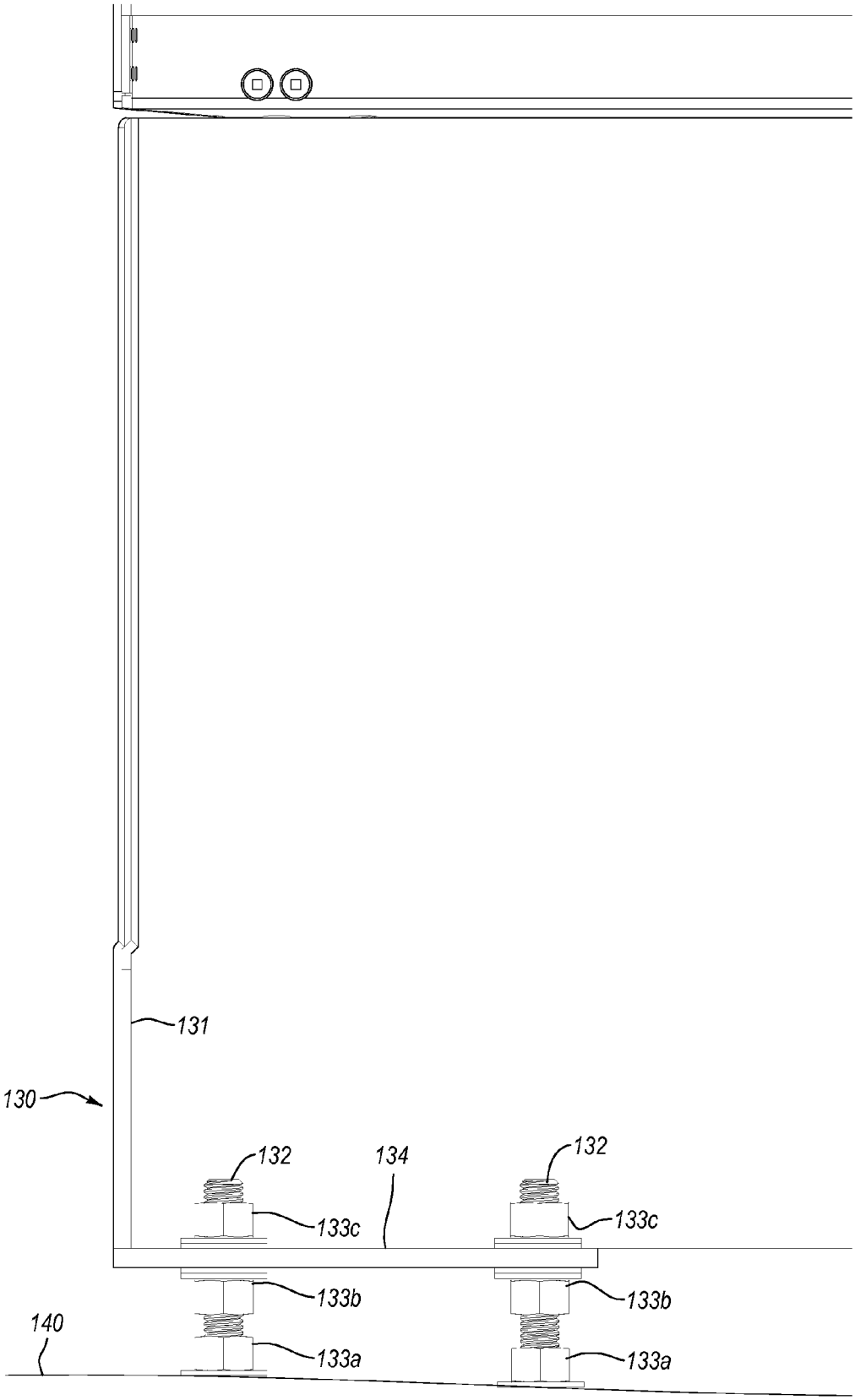
FIG. 2 is a side view of an architectural wall system depicting crude leveling above an uneven floor.

The lower frame 130 may be connected to a permanent structure, such as a floor or a wall. In one implementation, as depicted in FIG. 2, the lower frame 130 can be connected to a floor 140. One will appreciate that the height of the lower frame 130 can vary. For example, in one implementation, the lower frame 130 may be less than about six inches in height. In other implementations the height of the lower frame 130 can be about six or more inches.

Ideally, the architectural wall system 100 can be secured to a flat, level floor, allowing the wall 111 to be horizontally leveled by simply aligning the architectural wall system 100 flush against the floor. However, a flawed floor slab is common in construction and even more common in constructions with raised floors. FIG. 2 illustrates the lower frame 130 of the architectural wall system 100 secured to an uneven floor 140. The uneven floor 140 may require both suspension of the wall 111 above the uneven surface and leveling of the wall 111 to compensate for slopes or irregularities of the floor 140. While crude adjustments can be made by masonry, carpentry, or metalworking adjustments (such as grinding the uneven floor flat), these options may be time consuming and costly and may not be feasible in certain circumstances.

Rather than relying on masonry, carpentry, or metalworking adjustments, the lower frame 130 can allow crude leveling adjustments to be made. When secured to a permanent structure (such as floor 140), the connection of the lower frame 130 to the permanent structure can crudely level the lower frame 130 such that a support member 131 stands in a substantially vertical orientation and/or a base member 134 is oriented in a substantially horizontal orientation. In the implementation shown in FIGS. 1 and 2, the lower frame 130 is secured to the floor 140 by a 3-point connection comprising a set of threaded studs 132, a first set of hex nuts 133*a*, a second set of hex nuts 133*b*, and a third set of hex nuts 133*c*. The 3-point connection provides displacement, and therefore crude leveling, of the support member 131 and/or the base member 134.

The crude leveling is accomplished by inserting the set of threaded studs 132 into holes or recesses in the floor 140 and positioning the first set of hex nuts 133*a* on the set of threaded studs 132. The relative positioning of the first set of nuts 133*a* on the studs 132 can determine how deep the studs 132 are inserted into the floor 140. Once the studs 132 are inserted into the floor 140 as desired, the second set of nuts 133*b* are positioned on the studs 132. Moving one or more nuts in the second set of hex nuts 133*b* on the set of threaded studs 132 allows tilting of the lower frame 130. In other words, positioning one or more of the nuts 133*b* (on their respective studs 132) at different heights causes the base member 134 to tilt. Due to the triangular arrangement of the set of threaded studs 132, as seen in FIG. 1, the orientation of the lower frame 130, and thus the architectural wall system 100, can be adjusted in substantially any direction.

Once the support member 131 is substantially vertically oriented and/or the base member 134 substantially horizontally oriented, the base member 134 can then be secured in place upon the second set of hex nuts 133*b* by the third set of hex nuts 133*c*. One will appreciate that in other implementations, the crude leveling could be enabled by washers, bushings, or similar spacing adjusters between the base member 134 and the permanent structure.

Once the lower frame 130 is secured to the floor 140 and the crude leveling is completed, installation of the raised floor can be undertaken or completed. Notably, after installation of the raised floor in completed, the connection of the lower frame 130 to the permanent structure may be inaccessible without significant disassembly of the raised floor. Therefore, the primary, crude leveling of the lower frame 130 relative to the permanent structure in tandem with the fine leveling achieved with the intermediate displacement mechanism 120 (described in detail below) allows easier, more rapid adjustment and repairs of the wall 111 compared to prior designs.

One will appreciate that terms such as upper and lower are merely descriptive of the relative position of components. In another embodiment, the architectural wall system 100 may be substantially similar, however inverted, to allow attachment to, and leveling relative to, a ceiling instead of a floor. Similarly, the architectural wall system 100 may be turned 90 degrees to facilitate attachment to a wall without substantial alteration. The lower frame 130, regardless of orientation of the architectural wall system 100, may be used to secure the architectural wall system 100 to the permanent structure.

Figure 3:
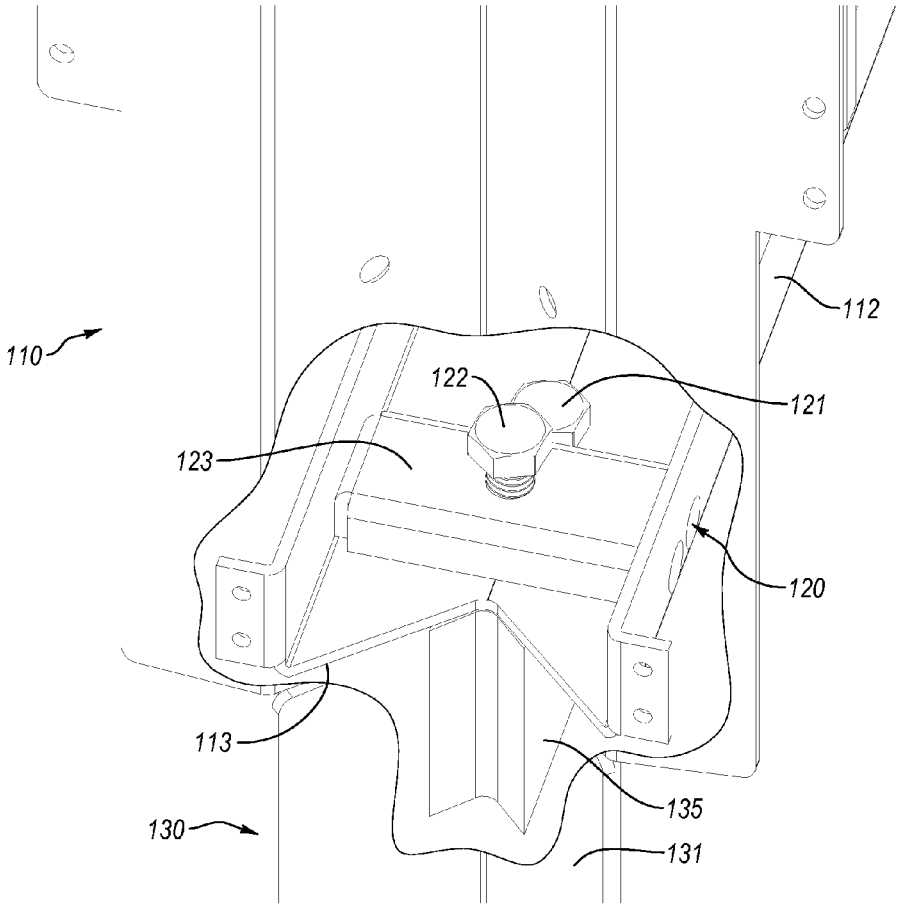
FIG. 3 is a cutaway perspective view of an architectural wall system showing the connection of an upper frame to a lower frame by an intermediate displacement mechanism.
Figure 4:
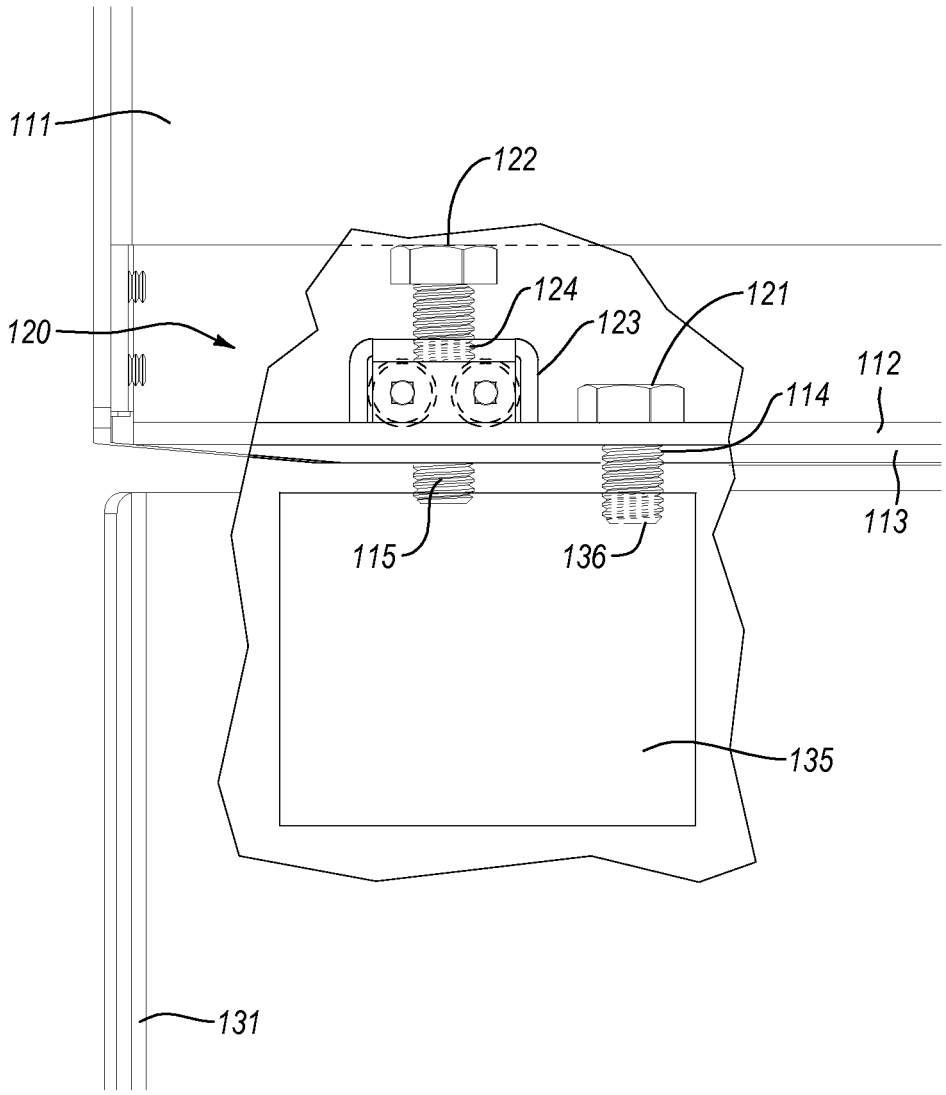
FIG. 4 is a cutaway side view of an architectural wall system depicting the internal structure of an intermediate displacement mechanism.

FIGS. 3-4 depict cutaway views showing the intermediate displacement mechanism 120 according to one exemplary implementation. The intermediate displacement mechanism 120 is connected between the upper frame 110 and the lower frame 130 and can provide a spacing between the upper frame 110 and the lower frame 130 for fine adjustment of the vertical position of the wall 111 independent of the attachment to the floor 140.

As seen in FIGS. 3-4, the intermediate displacement mechanism 120 comprises a pair of bolts. A first bolt 121 affixes the upper frame 110 to the lower frame 130 through an unthreaded hole 114 in a horizontal member 112 of the upper frame 110 and a complimentarily threaded hole 136 in a connection block 135 affixed to the support member 131 of the lower frame 130.

A second bolt 122 passes through a threaded hole 124 in a leveling bracket 123, which is affixed to the horizontal member 112 of the upper frame 110. The second bolt 122 also passes through an unthreaded hole 115 in the horizontal member 112 before contacting the connection block 135 of the lower frame 130. The interaction between the second bolt 122, the leveling bracket 123, and the connection block 135 provides a displacement force to adjust the height of the upper frame 110 relative to the lower frame 130.

More particularly, as the second bolt 122 is threaded further through the threaded hole 124 in the leveling bracket 123, a distal end of the second bolt 122 extends further out of the unthreaded hole 115 and engages the connection block 135. (In some embodiments, the second bolt 122 engages a top surface of the connection block 135. In other embodiments, such as that shown in FIG. 4, the second bolt 122 extends into a recess formed in the top surface of the connection block 135. A recess in the connection block 135 can facilitate and/or maintain proper alignment between the upper frame 110 and the lower frame 130 and/or between the components of the intermediate displacement mechanism 120.) As the second bolt 122 extends further through the leveling bracket 123, by tightening the bolt 122 against the connection block 135, the second bolt 122 causes at least a portion of the upper frame 110 to be raised, thereby allowing for further leveling of the wall 111. Likewise, loosening the second bolt 122 (i.e., rotating the second bolt 122 to retract the distal end further into the leveling bracket 123) causes at least a portion of the upper frame 110 to be lowered, which may also allow for further leveling of the wall 111. Furthermore, since the second bolt 122 can be finely adjusted, the longitudinal leveling of the wall 111 can likewise be finely adjusted with the use of the intermediate displacement mechanism 120.

In another implementation, the intermediate displacement mechanism 120 may comprise a motorized, hydraulic, or pneumatic piston. In yet another implementation, the intermediate displacement mechanism 120 can comprise a spring, shock, bushing, or similar expansive spacer configured to displace the upper frame 110 away from the lower frame 130. The spacing between the upper frame 110 and the lower frame 130 can then be adjusted by a bolt providing a compressive force counteracting the displacement force. The threaded stud may also function to affix the upper frame 110 to the lower frame 130.

Figure 5:
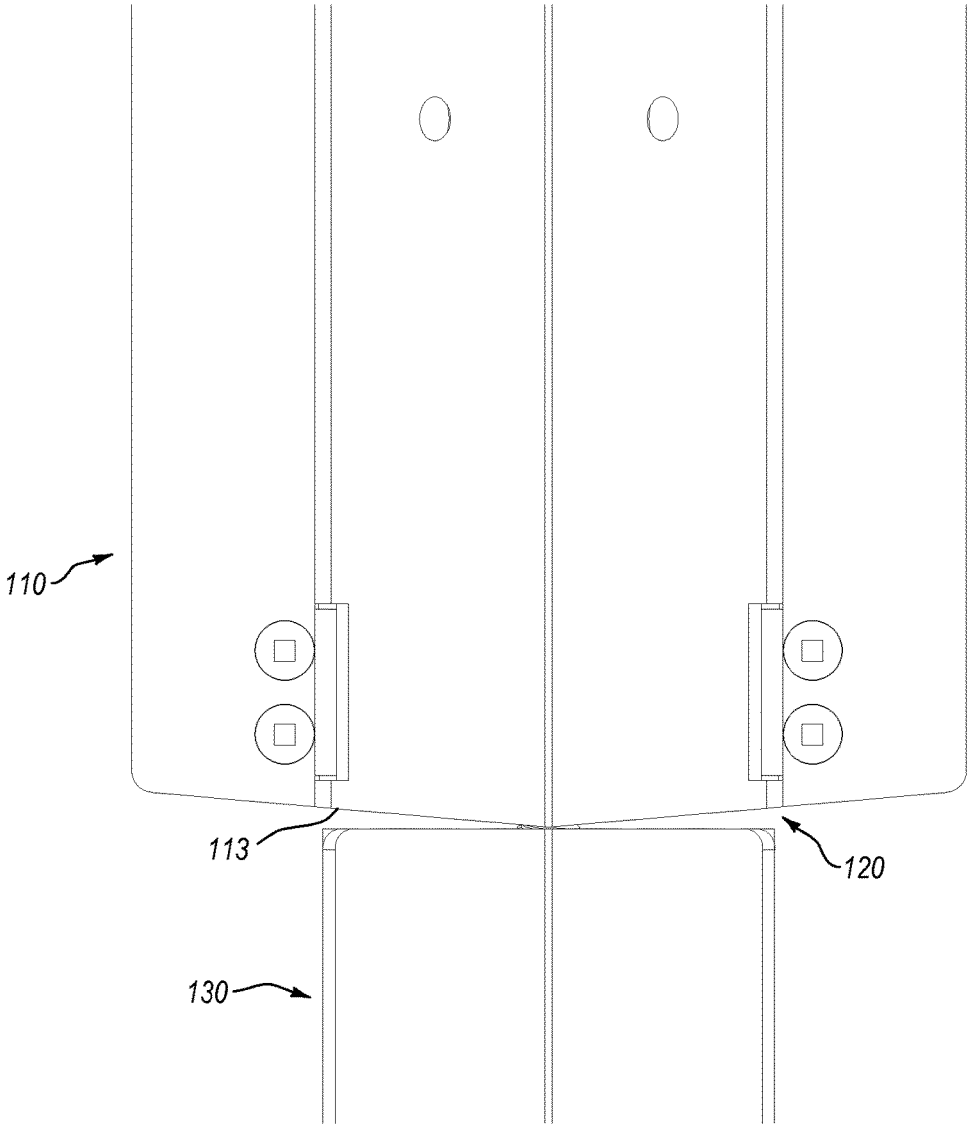
FIG. 5 is an end view of an architectural wall system depicting a beveled base of an upper frame allowing lateral pivoting of the upper frame.

The architectural wall system 100 as described herein can ensure the upper frame 110 and/or wall 111 is level longitudinally. Additionally, the architectural wall system 100 may also allow the upper frame 110 and wall 111 to pivot up to six inches laterally in the event of impacts, earthquakes, building sway, or similar lateral forces that may act on the upper frame 110 and/or wall 111. In the embodiment illustrated in FIG. 5, the horizontal member 112 of the upper frame 110 has a beveled base 113 at the point where the upper frame 110 connects to the lower frame 130. The beveled base 113, even when the upper frame 110 and lower frame 130 are in direct contact, allows the upper frame 110 and/or wall 111 to pivot laterally without damage to any components. In another embodiment, the lower frame 130 has a beveled top in alternative or addition to the beveled base 113 of the upper frame 110. In yet another embodiment, the beveled base 113 or beveled top may alternatively be rounded.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An architectural wall system comprising:

a lower frame;

an upper frame connected to the lower frame;

a wall connected to the upper frame; and a horizontal leveler configured to be attached between a first end of the wall and a permanent structure, wherein the horizontal leveler allows a vertical position of the first end of the wall to be selectively adjusted at both a crude level and a fine level relative to the permanent structure, wherein the horizontal leveler comprises:

a connection block connected to the lower frame;

a leveling bracket connected to the upper frame;

a first bolt that extends through the upper frame and into a threaded hole in the connection block to connect the upper frame and the lower frame together; and a second bolt that extends through the leveling bracket such that a distal end of the second bolt can engage the connection block.

2. The architectural wall system of claim 1, wherein the lower frame is connectable to the permanent structure.

3. The architectural wall system of claim 1, wherein adjustment of the second bolt relative to the leveling brackets adjusts the vertical position of the first end of the wall.

4. The architectural wall system of claim 1, wherein the fine level of vertical position is adjusted between the upper frame and the lower frame.

5. The architectural wall system of claim 1, wherein the crude level of vertical position is adjusted between the lower frame and the permanent structure.

6. The architectural wall system of claim 1, wherein the horizontal leveler comprises an intermediate displacement mechanism configured to provide a displacement force between the upper and lower frame.

7. The architectural wall system of claim 6, wherein the intermediate displacement mechanism comprises the first bolt and the second bolt, the second bolt being movable against the lower frame to provide the fine level adjustment between the upper frame and the lower frame.

8. The architectural wall system of claim 1, wherein the horizontal leveler allows a second end of the wall to pivot up to about 6 inches of lateral displacement, wherein the second end of the wall is distal to the first end of the wall.

9. An architectural wall system comprising:

a wall;

an upper frame having a v-shaped bottom end;

a lower frame adjustably connected to the v-shaped bottom end of the upper frame; and a horizontal leveler configured to adjust the leveling of the wall, the horizontal leveler comprising:

an intermediate displacement mechanism configured to provide a displacement force between the upper frame and the lower frame, wherein the intermediate displacement mechanism comprises:

a connection block connected to the lower frame;

a leveling bracket connected to the upper frame;

a first bolt that extends through the upper frame and into a threaded hole in the connection block to connect the upper frame and the lower frame together; and a second bolt that extends through the leveling bracket such that a distal end of the second bolt can engage the connection block.

10. The architectural wall system of claim 9, wherein the leveling bracket comprises a threaded hole through which the second bolt extends.

11. The architectural wall system of claim 9, wherein the upper frame comprises an unthreaded hole through which the first bolt extends.

12. The architectural wall system of claim 9, wherein adjusting how far the second bolt extends out of the leveling bracket adjusts leveling of the upper frame.

13. The architectural wall system of claim 9, wherein the intermediate displacement mechanism comprises a piston, a spring, or a bushing.

14. The architectural wall system of claim 9, wherein the permanent structure is a floor.

15. The architectural wall system of claim 9, wherein the wall is connected to the upper frame.

16. The architectural wall system of claim 9, wherein the horizontal leveler comprises an adjustable 3-point connection between the lower frame and a permanent structure.

17. The architectural wall system of claim 9, wherein the v-shaped bottom end of the upper frame enables the upper frame to pivot laterally relative to the lower frame.

18. An apparatus for leveling an architectural wall, the apparatus comprising:

an upper frame having a first end and a second end;

a lower frame connected to the upper frame and having a first end and a second end, the lower frame being configured to adjustably connect the second end of the lower frame to a permanent structure; and an intermediate displacement mechanism connecting the second end of the upper frame to the first end of the lower frame, wherein the intermediate displacement mechanism comprises:

a connection block connected to the lower frame;

a leveling bracket connected to the upper frame;

a first bolt that extends through the upper frame and into a threaded hole in the connection block to connect the upper frame and the lower frame together; and a second bolt that extends through the leveling bracket such that a distal end of the second bolt can engage the connection block.

19. The apparatus of claim 18, wherein the second end of the upper frame is v-shaped.

20. The apparatus of claim 18, wherein the upper frame is capable of supporting an architectural wall.

21. The apparatus of claim 18, wherein the second end of the lower frame comprises a 3-point connection for connecting the lower frame to a permanent structure.

22. The apparatus of claim 18, wherein (i) the first bolt extends through an unthreaded hole in the upper frame and into a threaded hole in the connection block, and (ii) the second bolt extends through a threaded hole in the leveling bracket.

23. A method for installing an architectural wall, the method comprising:

connecting a lower frame to a surface of a permanent structure;

crudely adjusting the connection between the lower frame and the surface of the permanent structure such that the lower frame stands about vertically;

connecting an upper frame to the lower frame by extending a first bolt through an unthreaded hole in the upper frame and into a threaded hole in connection block associated with the lower frame; and finely adjusting the connection between the upper frame and the lower frame such that the upper frame is level, wherein finely adjusting the connection comprises extending a second bolt through a threaded hole in a leveling bracket associated with the upper frame and into contact with the connection block.

* * * * *